US006547952B1

(12) United States Patent
Staerzl

(10) Patent No.: US 6,547,952 B1
(45) Date of Patent: Apr. 15, 2003

(54) SYSTEM FOR INHIBITING FOULING OF AN UNDERWATER SURFACE

(75) Inventor: Richard E. Staerzl, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/905,658

(22) Filed: Jul. 13, 2001

(51) Int. Cl.[7] ..... B63B 59/00

(52) U.S. Cl. ..... 205/724; 205/740; 204/196.01; 204/196.37

(58) Field of Search ..... 205/724, 740; 204/196.01, 196.37

(56) References Cited

U.S. PATENT DOCUMENTS

| | | | | |
|---|---|---|---|---|
| 948,355 | A | 2/1910 | Tatro et al. | |
| 1,021,734 | A | 3/1912 | Delius et al. | |
| 3,069,336 | A | 12/1962 | Waite et al. | 204/148 |
| 3,241,512 | A | 3/1966 | Green | 114/222 |
| 3,497,434 | A | 2/1970 | Littauer | 204/147 |
| 3,625,852 | A | 12/1971 | Anderson | 204/196 |
| 3,661,742 | A | 5/1972 | Osborn et al. | 204/147 |
| 3,721,574 | A | 3/1973 | Schneider et al. | 106/74 |
| 3,766,032 | A | 10/1973 | Yeiser | 204/147 |
| 4,046,094 | A | 9/1977 | Preiser | 114/222 |
| 4,058,075 | A | 11/1977 | Piper | 114/222 |
| 4,092,943 | A | 6/1978 | Lund et al. | 114/222 |
| 4,162,169 | A | 7/1979 | Schutt | 106/74 |
| 4,170,185 | A | 10/1979 | Murphy et al. | 114/222 |
| 4,196,064 | A | 4/1980 | Harms et al. | 204/147 |
| 4,283,461 | A | 8/1981 | Wooden et al. | 428/422 |
| 4,297,394 | A | 10/1981 | Wooden et al. | 427/100 |
| 4,322,633 | A | 3/1982 | Staerzl | 307/95 |
| 4,559,017 | A | 12/1985 | Cavil et al. | 440/76 |
| 4,869,016 | A | 9/1989 | Diprose et al. | 43/124 |
| 4,943,954 | A | 7/1990 | Ostlie | 367/191 |
| 5,052,962 | A | 10/1991 | Clark | 440/83 |
| 5,088,432 | A | 2/1992 | Usami et al. | 114/67 |
| 5,143,011 | A | 9/1992 | Rabbette | 114/222 |
| 5,298,794 | A | 3/1994 | Kuragaki | 307/95 |
| 5,342,228 | A | 8/1994 | Magee et al. | 440/76 |

(List continued on next page.)

FOREIGN PATENT DOCUMENTS

WO WO98/18855 10/1999

OTHER PUBLICATIONS

"Chemistry and Industry" by Maureen Callow, Section 5, p. 123, Mar. 5, 1990.

"Tinker Concocts a Barnacle Paint with McCormick's Peppers", Baltimore Business Journal, vol. 10, No. 47, Section 1, p. 3, Apr. 23, 1993.

Brochure—Adsil Corporation (No date).

*Primary Examiner*—Arun S. Phasge
(74) *Attorney, Agent, or Firm*—William D. Lanyi

(57) ABSTRACT

An electrically conductive surface is combined with a protective surface of glass in order to provide an anode from which electrons can be transferred to seawater for the purpose of generating gaseous chlorine on the surface to be protected. Ambient temperature cure glass (ATC glass) provides a covalent bond on an electrically conductive surface, such as nickel-bearing paint. In this way, boat hulls, submerged portions of outboard motors, and submerged portions of stern drive systems can be protected effectively from the growth of marine organism, such as barnacles. The electrically conductive surface generates electrons into the seawater in order to create chlorine gas at the surface which inhibits and discourages marine growth. The protective coating of glass inhibits the migration of metal ions from the electrically conductive surface into the seawater and therefore inhibits corrosive degradation as a result of galvanic action.

30 Claims, 6 Drawing Sheets

U.S. PATENT DOCUMENTS

| | | | | | |
|---|---|---|---|---|---|
| 5,344,531 | A | | 9/1994 | Saito et al. | 204/147 |
| 5,386,397 | A | | 1/1995 | Urroz | 367/139 |
| 5,465,676 | A | | 11/1995 | Falcaro | 114/222 |
| 5,532,980 | A | | 7/1996 | Zarate et al. | 367/139 |
| 5,552,656 | A | | 9/1996 | Taylor | 310/337 |
| 5,643,424 | A | * | 7/1997 | Riffe et al. | 204/740 |
| 5,716,248 | A | | 2/1998 | Nakamura | 440/76 |
| 5,735,226 | A | | 4/1998 | McNeal | 114/222 |
| 5,820,737 | A | | 10/1998 | Kohn | 204/196 |
| 5,889,209 | A | | 3/1999 | Piedrahita et al. | 73/570 |
| 5,929,159 | A | | 7/1999 | Schutt et al. | 524/544 |
| 6,161,989 | A | | 12/2000 | Kotani et al. | 405/151 |
| 6,173,669 | B1 | | 1/2001 | Staerzl | 114/222 |
| 6,187,447 | B1 | | 2/2001 | Stein et al. | 428/447 |
| 6,209,472 | B1 | | 4/2001 | Staerzl | 114/222 |

* cited by examiner

SYSTEM FOR INHIBITING FOULING OF AN UNDERWATER SURFACE

BACKGROUND OF THE INVENTION

1. Field of the Invention

The present invention is generally related to an apparatus and method for inhibiting the fouling of an underwater surface and, more particularly, to a combination of a metallic coating and a protective glass coating which permits electrons to pass through the protective coating between the metal coating and the seawater while inhibiting the transfer of ions between the metallic coating and the seawater, whereby gaseous chlorine is formed on and in the vicinity of the protective coating to inhibit the growth of organic material on the surface of the underwater object.

2. Description of the Prior Art

Throughout the following discussion of the prior art and the description of the present invention, the unwanted growth on a ship's hull or other underwater surface will be referred to as fouling. Although fouling is primarily a biological phenomenon, its implications relate to engineering. Due to an increase in the resistance to movement of the hull through water, fouling of the hulls of ships results in a reduction in speed, an increase in the cost of fuel, and losses in both time and money in the application of remedial measures.

Underwater surfaces rapidly absorb organic material, referred to as conditioning films, which may influence the subsequent settlement of microorganisms. Bacteria and diatoms are soon present after immersion in water, resulting in a slime that covers the submerged surface. Following the establishment of the micro fouling slime layer, macro fouling rapidly develops. The macro fouling community is often described as either soft fouling or hard fouling. Soft fouling comprises algae and invertebrates such as soft corals, sponges, anemones, tunicates, and hydroids while hard fouling comprises invertebrates such as barnacles, mussels, and tubeworms.

Various toxic and non-toxic solutions have been attempted. Both ultrasonic (e.g. 14 kHz) and low frequency (e.g. 30 Hz) sound waves inhibit barnacle settlement and may have application to fouling control in certain circumstances. These and many other anti-fouling techniques are described in an article written by Maureen Callow in the publication titled "Chemistry and Industry" at Section 5, pg. 123, on Mar. 5, 1990.

As described in the Baltimore Business Journal, Vol. 10, No. 47, Section 1, pg. 3 on Apr. 23, 1993, McCormick & Company has discovered that its red pepper extracts are natural repellents of barnacles and zebra mussels. A coating of this type has been tested, and it has been determined that it repels both barnacles and zebra mussels which have become costly nuisances in the Great Lake Region by clogging intake pipes for power plants and water treatment plants. It is estimated that several billion dollars in damage will be caused by zebra mussels before the turn of the century.

U.S. Pat. No. 5,532,980, which issued to Zarate, et al on Jul. 2, 1996, discloses a vibrational anti-fouling system. The system produces vibrations in an underwater structure for the purpose of inhibiting the attachment of aquatic life forms to the structure. The system includes a controller which drives one or more transducers. The transducer comprises a housing, one end of which is closed by a resilient diaphragm.

An electromagnet with soft magnetic core is contained in the housing spaced from the unsupported portion of the diaphragm. The unsupported portion of the diaphragm is mounted over an underwater structure. In operation, the electromagnet is excited with a current pulse, which deforms the diaphragm so that the housing moves towards the structure. As the current drops off, the diaphragm is restored to its original shape and the housing moves away from the structure imparting a vibrational force to the structure. The transducer includes an elastic membrane to compensate the changes in temperature and pressure commonly found when working underwater. The magnetic cores positioned in the transducers are saturated by current pulses generated by the controller to eliminate the effects of component variations and allow multiple units to be connected to the controller without changes in sound levels. The system is highly resistant to electrolytic corrosion since, most of the time, there is no voltage difference between the resonators, wires and ground.

U.S. Pat. No. 5,386,397, which issued to Urroz on Jan. 31, 1995, describes a method and apparatus for keeping a body surface, which is in contact with water, free of fouling. A sound wave is generated for keeping a surface free of scale, fouling and dirt by the adherence of organisms such as marine life, the surface being part of the body that is in contact with water. The method comprising of steps of generating and emitting from at least one location of the body, at least one high frequency sound wave train forming, adjacent to the body surface, a vibrating field encircling the body surface. The molecular energy of the water within the field is increased to generate a drastic drop in the density of the water as well as the density of the cells of the organisms entering the vibrating field. This alters the habitat of the organisms and discourages the organisms from adhering to the body surface.

U.S. Pat. No. 4,058,075, which issued to Piper on Nov. 15, 1977, discloses a marine life growth inhibitor device. The device is used for inhibiting marine life on the outer surface of submerged object such as boat. The device includes a controller connected to a source of electrical power and a plurality of speakers electrically connected to the controller and attached at predetermined locations on the interior of the boat's hull, whereby vibrations may be transmitted through the hull. The controller may also include a transformer for reducing the voltage of the alternating current power source. Each of the plurality of speakers has a speaker diaphragm having first and second speaker diaphragm sides. Each of the speakers is mounted in a speaker housing secured to the hull of the boat for enabling transfer of acoustical energy from both the first and second side of the speaker diagram to the boat hull to inhibit the growth of marine life on the exterior surface of the boat hull. The speakers are selected to produce acoustical vibration in the audible range.

U.S. Pat. No. 5,143,011, which issued to Rabbette on Sep. 1, 1992, discloses a method and apparatus for inhibiting barnacle growth on boats. The system for inhibiting growth of barnacles and other marine life on the hull of a boat includes a plurality of transducers or vibrators mounted on the hull and alternately energized at a frequency of 25 Hertz through a power source preferably the boat battery, and a control system. The system has two selectable operating modes. One is continuous and the other is periodic. Also, when the voltage of the battery falls below a predetermined level, transducers are automatically deenergized to allow charging of the battery after which the transducers are energized.

U.S. Pat. No. 3,241,512, which issued to Green on Mar. 22, 1966, describes an anti-fouling, barnacles, algae, eliminator. The apparatus is intended for boats and, in particular, comprises a pair of copper bus bars or electrodes, or a pair of perforated tubes, or both the electrodes and perforated tubes positioned on opposite sides of the keel of a boat whereby copper ions, chlorine gas or bubbles, or combination of the ions and chlorine gas produced bubbles that float upward from the keel on both sides thereof following the contour lines of the boat hull cleaning the surface thereof and removing barnacles, algae, and other foreign and undesirable matter.

U.S. Pat. No. 3,625,852, which issued to Anderson on Dec. 7, 1971, describes a marine anti-fouling system. The system is intended for use with boat and ship hulls having a keel and sides diverging upwardly therefrom. The anti-fouling system comprises a pair of laterally spaced elongated anode electrode components each mounted externally on one side of the hull substantially adjacent the keel and lengthwise thereof. It also comprises an elongated cathode electrode component mounted externally on and lengthwise of the keel in spaced relationship between the anode electrode components. The system further comprises a source of electrical current and electrical circuit means therefor for energizing the anode electrode components with a positive potential and the cathode electrode components with a negative potential with the cathode electrode component being electrolytically common to the anode electrode components.

U.S. Pat. No. 5,465,676, which issued to Falcaro on Nov. 14, 1995, discloses a barnacle shield. A system for discouraging and inhibiting marine growth onto a boat's underwater hull surface comprises a plurality of sections of foam filled PVC pipe tied together to form a flotation frame, an envelope of flexible, polyethylene, bubble wrap material, of a size and shape to enclose the underwater part of a boat's hull, and affixed to and supported by the flotation frame, a sprinkler hose affixed to the flotation frame for injecting fresh water for washing the boat's underwater hull, and a plurality of drain/check valves mounted in the envelope for eliminating the wash down water in the envelope.

U.S. Pat. No. 4,170,185, which issued to Murphy et al on Oct. 9, 1979, describes a means for preventing marine fouling. The effective antifouling result with respect to marine creatures such as barnacles is achieved by energizing a piezofilm layer carried on the outside of a vessel to cause mechanical vibration of the layer.

U.S. Pat. No. 4,046,094, which issued to Preiser et al on Sep. 6, 1977, discloses an antifouling system for active ships which are at rest. A system for discouraging and inhibiting growth of the entire marine fouling community onto a ship hull while it is at rest in brackish or seawater is described. A pipe or pipes having nozzles distributed therealong, run the length of the keel. Fresh water is supplied to the pipe which flows out the nozzles and up along the hull to create and maintain a moving boundary layer of fresh water. Such movement also serves to inhibit fouling. An enclosure comprising segmented, over-lapping opaque curtains hang down by weights, from the ship-deck. These curtains serve to prevent light from reaching the hull, and to protect the thin boundary layer of fresh water from the disruptive, mixing actions caused by the surrounding currents. Thus the marine fouling community, including tubeworns, barnacles, grass, and algae, may be inhibited from growing and adhering to the hull surface.

U.S. Pat. No. 4,283,461, which issued to Wooden et al on Aug. 11, 1981, describes a piezoelectric polymer antifouling coating. An antifouling coating for marine structures in the form of a film containing piezoelectric polymer material, which, when electrically activated vibrates at a selected frequency to present a surface interfacing with water which is inhospitable for attachment of vegetable and animal life including free-swimming organisms thereby discouraging their attachment and their subsequent growth thereon to the macrofoulant adult stage is disclosed.

U.S. Pat. No. 5,342,228, which issued to Magee et al on Aug. 30, 1994, discloses a marine drive which is provided with a large volume anode, about 30 cubic inches, for. galvanic protection. The anode is a brick-like block member tapered along each of its height, width, and length dimensions. The drive housing has a anode mounting section extending rearwardly therefrom and has a downwardly opening cavity of substantially the same shape and volume as the anode, and receiving the anode in nested flush relation.

U.S. Pat. No. 5,716,248, which issued to Nakamura on Feb. 10, 1998, discloses a sacrificial anode for a marine propulsion unit. The sacrificial anode arrangements for a marine propulsion unit is disclosed wherein the sacrificial anode is juxtaposed to the trim tab and is detachably connected to the lower unit housing by fastening means which can be removed from the upper surface thereof. In one embodiment, the trim tab is detachably connected to the sacrificial anode and is connected to the outer housing portion through the sacrificial anode.

U.S. Pat. No. 5,298,794, which issued to Kuragaki on Mar. 29, 1994, describes an electrical anticorrosion device for a marine propulsion apparatus. The device primarily relates to an electrical anticorrosion apparatus for a marine propulsion arrangement. More particularly, the device relates to an anodic protection arrangement which is suitable for use with an inboard/outboard propulsion unit. According to the description in this patent, an anode and the reference electrode are housed within a housing unit which is mounted upon a propulsion unit mounting bracket. The two electrodes are arranged so that each is essentially equidistant from a point located approximate midway across the lateral width of an outboard drive unit, which unit is secured to the mounting bracket, when the unit is positioned for driving the associated watercraft in a generally forward direction.

U.S. Pat. No. 4,322,633, which issued to Staerzl on Mar. 30, 1982, discloses a marine cathodic protection system. The system maintains a submerged portion of the marine drive unit at a selected potential to reduce or eliminate corrosion thereto. An anode is energized to maintain the drive unit at a pre-selected selected constant potential in response to the sensed potential at a closely located reference electrode during operation. Excessive current to the anode is sensed to provide a maximum current limitation. An integrated circuit employs a highly regulated voltage source to establish precise control of the anode energization.

U.S. Pat. No. 5,052,962, which issued to Clark on Oct. 1, 1991, describes a naval electrochemical corrosion reducing. The corrosion reducer is used with ships having a hull, a propeller mounted on a propeller shaft and extending through the hull, therein supporting the shaft, at least one thrust bearing and one seal. Improvement includes a current collector and a current reduction assembly for reducing the voltage between the hull and shaft in order to reduce corrosion due to electrolytic action. The current reduction assembly includes an electrical contact, the current collector, and the hull. The current reduction assembly further includes a device for sensing and measuring the voltage between the hull and the shaft and a device for applying a reverse voltage between the hull and the shaft so that the resulting voltage differential is from 0 to 0.05 volts. The current reduction assembly further includes a differential amplifier having a voltage differential between the hull and the shaft. The current reduction assembly further includes an amplifier and the power output circuit receiving signals from the differential amplifier and being supplied by at least one current supply. The current selector includes a brush assembly in contact with a slip ring over the shaft so that its potential may be applied to the differential amplifier.

U.S. Pat. No. 4,559,017, which issued to Cavil et al on Dec. 17, 1985, discloses a constant voltage anode system. The marine propulsion unit has a housing exposed to sea water and subject to attack by the sea water. It has a permanent type anode housing with a substantially constant surface characteristic which is mounted on the housing and supplied with constant voltage. Holes under the anode through the housing which extend to interior passages permits the current of the anode to influence and protect the passages.

U.S. Pat. No. 3,497,434, which issued to Littauer on Feb. 24, 1970, discloses a method for preventing fouling of metal in a marine environment. It anodically dissolves metals that are toxic to marine organisms. This is done under controlled conditions to prevent fouling by marine organisms of structures immersed in a marine environment.

U.S. Pat. No. 5,889,209, which issued to Piedrahita et al on Mar. 30, 1999, describes a method and apparatus for preventing biofouling of aquatic sensors. A submersible ultrasonic emitter is integrated with a dissolved oxygen or other aquatic probe so that biofouling of the sensors' membrane is minimized. Sonification, that is, exposure to ultrasound, precludes the needs to use other biofouling elimination procedures such as water/air jets, chemical treatments, or biocides. The invention can be configured to readily integrate with existing probes from a variety of manufacturers, and eliminates membrane cleaning as the maintenance interval constraint for field or laboratory deployed sensors.

U.S. Pat. No. 5,735,226, which issued to McNeal on Apr. 7, 1998, describes a marine anti-fouling system and method. The system and method is disclosed for inhibiting the growth of marine life on a submerged surface and includes a control box and a number of transducers. The control box further includes an ultrasonic driver board, a magna-polar filter, and a power source. The ultrasonic driver board generates an electrical signal having an ultrasonic frequency which continually varies between 25 KHz and 60 KHz. A portion of this continually varying electrical signal is passed through the magna-polar filter where the signal is enhanced. This enhanced signal is then returned to the ultrasonic driver board where is combined with the electrical signal varying between 25 KHz and 60 KHz. This combined signal is then electrically communicated to a number of transducers which are mounted on the submerged surface to be protected. There, the electrical signal having combined frequencies is translated from electrical energy to acoustic energy which is transmitted to the submerged surface to inhibit the growth of marine life on the submerged surface.

U.S. Pat. No. 5,552,656, which issued to Taylor on Sep. 3, 1996, describes a self-powered anti-fouling device for watercraft. The device comprises a layer of piezoelectric material, preferably a poled plastic material such as a PVDF polymer, for mounting on the hull of a watercraft. The layer has electrodes on opposite major surfaces thereof, and the layers are connected to a power supply comprising a battery and a d.c to a.c. converter. The converter generates an a.c. voltage at a frequency, such as 20 KHz, for causing vibrations of the layer, such vibrations serving to retard the growth of water dwelling organisms in the craft. The layer electrodes are also connected to an a.c. to d.c. converter for converting a.c. energy to d.c. energy suitable for trickle charging the power supply battery. Accordingly, during transit of the craft through the water, water induced hull vibrations cause vibrations of the layer for generating a.c. energy for storage in the battery, which stored energy is used for causing anti-fouling vibrations of the energy generating layer.

U.S. Pat. No. 4,943,954, which issued to Ostlie on Jul. 24, 1990, describes a method and system for counteracting marine biologic fouling of a hull or submerged construction. A system and a method for counteracting marine fouling of a vessel hull are provided. Electro-mechanical vibration transducers are arranged in pairs adjacent to fixed nodal lines on the hull and are driven in an inverted phase relationship in order to provide a water particle movement in a hull parallel direction right outside side nodal lines in addition to the hull perpendicular relative movements right outside the transducers. The invention also comprises a combination of the mechanical system above and a special surface coating which counteracts fouling from other organisms than those influenced by the water particle movement in the infrafrequency range.

U.S. Pat. No. 4,058,075, which issued to Piper on November 15, 1977, describes a marine life growth inhibitor device. The device is used for inhibiting marine life on the outer surface of a submerged object such as a boat. The device includes a controller connected to a source of electrical power and a plurality of speakers electrically connected to the controller and attached at predetermined locations on the interior on the boat's hull, whereby vibrations maybe transmitted through the hull. The controller may also include a transformer for reducing the voltage of the alternating current power source. Each of the plurality of speakers has a speaker diaphragm having a first and a second speaker diaphragm side. Each of the speakers is mounted in a speaker housing secured to the hull of the boat for enabling transfer of acoustical energy from both the first and second side of the speaker diaphragm to the boat hull to inhibit the growth of marine life on the exterior surface of the boat hull. The speakers are selected to produce acoustical vibration in the audible range.

U.S. Pat. No. 4,092,943, which issued Lund et al on Jun. 6, 1978, describes a marine protection system. An underwater marine protection system for preventing or retarding marine growth on vessels, pilings, in submerged structures in which a boat slip, or the like, has a series of gas diffusers placed under the water located to direct gas towards the bottom of the marine vessel is described. The gas diffusers are connected to an ozone source for direction ozone gas through the diffusers towards the bottom of a boat. Skirts or curtains are connected to the pilings in the boat slip to prevent the free flow of water into and out of the slip where the water has been treated. A special top extends across the slip and around the vessel therein to increase the effectiveness of the ozone. An alternate embodiment has the gas diffusers formed in the bottom of the boat or submarine structure.

U.S. Pat. No. 4,170,185, which issued to Murphy et al on Oct. 9, 1979, discloses a system for preventing marine fouling. The effective antifouling result with respect to marine creatures such as barnacles is achieved by energizing a piezofilm layer carried on the outside of a vessel to cause mechanical vibrations of the layer.

U.S. Pat. No. 3,069,336, which issued to Waite et al on Dec. 18, 1962, discloses a means for protecting ships' hulls. The system relates to ships and in particular to the protection of metal hulls against corrosion, but it further relates to the protection of ships' hulls against fouling with barnacles or other similar marine growth and marine vegetation.

U.S. Pat. No. 3,766,032, which issued to Yelser on Oct. 16, 1973, discloses a method for controlling marine fouling. An electrical apparatus and method is disclosed for eliminating the fouling of boat bottoms and the like by marine growth. The underwater surface is sheathed with strips of metal such as stainless steel. An electric current is passed between the adjacent strips or areas, preferably for short periods of time on a regular maintenance schedule (e.g. 30 amperes per square foot for a few seconds every two days). The sheathing may be of 0.020" stainless steel in 3-inch wide strips spaced 0.100 inches apart. Test panels in sea water are found to remain clean and bright after six months immersion when so energized, while identical panels to which no current is applied become heavily fouled. Ions produced by electrolysis close to the sheathed surface move at relatively high velocities, and are found to kill the small organisms that settle on the surface. No persistent toxic chemicals such as mercury compounds are released into the water, and only minute quantities of dead organic matter are released at any time.

U.S. Pat. No. 3,661,742, which issued to Osborn et al on May 9, 1972, describes an electrolytic method of marine fouling control. The improved method of inhibiting the sustained attachment of marine organisms to metallic surfaces while preventing corrosion of the metallic surfaces by cathodic protection is disclosed. Inhibition of marine organisms attachment takes place when toxic ions are forced into solution by reversing and increasing the current density in the cathodic protection system at periodic intervals for short periods of time.

U.S. Pat. No. 1,021,734, which issued to Delius et al on Mar. 26, 1912, describes a process for protecting ships from barnacles. The invention relates to sea going vessels which have hulls which are either made of metal or sheathed with metal and is intended for protection of vessels from the accumulation of barnacles. This is accomplished by providing a means for electrically destroying the barnacles that may be attached to the ship.

U.S. Pat. No. 4,869,016, which issued to Diprose et al on Sep. 26, 1989, describes a marine biofouling reduction invention. The method provides a substantial reduction of marine corrosion in sea water by micro and macro biofouling. An alternating current is generated of sufficient strength and frequency sufficient to shock marine biofouling organisms and sufficient to upset the normal behavior patterns of the marine biofouling organisms and trained in the sea water passing around or through the structure. The device causes release into the water around or within the structure controlled amounts of chlorine ions and copper ions to produce an environment actively hostile to potential marine biofouling organisms.

U.S. Pat. No. 5,088,432, which issued to Usami et al on Feb. 18, 1992, describes a system for providing anti-fouling for substances in contact with sea water. It comprises a first conductive membrane that is coated on the outer side of the electric insulator mounted at the surface of the substance such as ships and composes thin sheets of metal having low specific resistance or metal oxide, spray-coated membrane, evaporated membrane, or fused membrane. The second conductive anti-fouling membrane has a higher electric resistance than the first conductive membrane.

U.S. Pat. No. 5,820,737, which issued to Kohn on Oct. 13, 1998, describes an anti-fouling laminate marine structure. The structure is submersible in sea water, such as a boat hull, and is electrically activated. The hull is formed of inner and outer skins. The outer skin forms an exposed surface and is coated with a metallic paint defining a cathode electrode. The core is constituted by balsa wood or foam plastic modules. This is attached to an open mesh material that includes conductive fibers to create an electrical grid defining anodic electrode that is embedded in the laminate.

U.S. Pat. No. 6,209,472, which issued to Staerzl on Apr. 3, 2001, discloses an apparatus and method for inhibiting fouling of an underwater surface. The system for inhibiting marine organism growth on underwater surfaces provides an electric current generator which causes an electric current to flow proximate the underwater surface. A power source, such as a battery, provides electrical power to the electric current generator. The flow of current passes from the underwater surface through the water surrounding the surface or in contact with the surface and a point of ground potential. The point of ground potential can be a marine propulsion system attached to a boat on which the underwater surface is contained.

U.S. Pat. No. 948,355, which issued to Tatro et al on Feb. 8, 1910, describes an expeditious and inexpensive means for removing pests from ship's bottoms and for protecting from such pests any non-metallic objects located or moving under seawater. The system uses the anode and the cathode of an electric battery and the two poles of the battery must both be in contact with the seawater so that the circuit of the electric current must be completed through the water.

U.S. Pat. No. 6,173,669, which issued to Staerzl on Jan. 16, 2001, discloses an apparatus and method for inhibiting fouling of an underwater surface. The marine fouling prevention system comprises two conductive surfaces and a device that alternates the direction of the electric current between the two surfaces. The current is caused to flow through seawater in which the two surfaces are submerged or partially submerged. A monitor measures the current flowing from one of the two conduction surfaces and compares it to the current flowing into the other conduction surface to assure that no leakage of current of substantial quantity exists. The system applies a low magnitude current density, of approximately 0.10 to 0.50 milliamperes per square foot, for an extended duration of time of approximately 10 to 20 minutes. By alternating current direction between the two surfaces, both surfaces can be provided with sufficient chlorine bubbles to prevent marine growth from attaching to the surfaces.

U.S. Pat. No. 5,929,159, which issued to Schutt et al on Jul. 27, 1999, describes an oligomeric silicon coating composition, articles coated therewith and method for forming coating composition and coated articles based thereon. Corrosion resistant coatings are provided by aqueous-alcoholic acidic dispersions of the partial condensate of monomethyl silanol (by hydrolysis of monomethyl alkoxysilane) alone or in admixture with minor amounts of other silanol, e.g. gamma-glycidyloxy silanol, phenyl silanol, etc., wherein the dispersions contain divalent metal cations, e.g., $Ca^{+2}$, in place of all or most of colloidal silica used in prior formulations of this type. The coatings may be applied to boat hulls, including aluminum hulls and are effective in preventing corrosion from salt water for extended periods.

U.S. Pat. No. 3,721,574, which issued to Schneider et al on Mar. 20, 1973, describes silicate coatings compositions. Water resistant and air drying alkali metal silicate coatings contain a base of an alkali metal silicate solution having a high molar ratio of solvated silica to alkali metal oxide. To this base is added colloidal silica in amounts to increase the $SiO_2$:alkali metal oxide mole ratio to as high as 9:1. The compositions are advantageously modified with silane wetting agents and multivalent metal ions, e.g., calcium. Ultimately, the coatings may be modified with various materials such as tetrafloroethylene polymer or zinc.

U.S. Pat. No. 4,162,169, which issued to Schutt on Jul. 24, 1979 describes an alkali-metal silicate binder and methods of manufacture. A paint binder utilizing a potassium or sodium silicate dispersion having a silicon dioxide to alkali-metal oxide mol ratio of from 4.8:1 to 6.0:1, in which the binder exhibits stability during both manufacture and storage is disclosed. The process of making the binder is predictable and repeatable and the binder may be made with inexpensive components. The high mol ratio is achieved with the inclusion of a silicon dioxide hydrogel. The binder, which also employs a silicone, is in the final form of a hydrogel sol.

U.S. Pat. No. 6,187,447, which issued to Stein et al on Feb. 13, 2001, describes a condensation curable silicone foul release coatings and articles coated therewith. Anti-fouling coatings comprise a room temperature vulcanizable polyorganosiloxane composition and a polyorganosiloxane free from silanol groups and comprising at least one hydroxy- or alkoxy-terminated polyoxyalkylenealkyl radical. The latter is capable of blooming to the surface of the cured room temperature vulcanizable composition, thus inhibiting the deposition of marine life on the coated article.

U.S. Pat. No. 6,161,989, which issued to Kotani et al on Dec. 19, 2000, describes an antifouling wall structure for use in pipe and method of constructing the antifouling wall therefor. A wall surface of a structure to be rendered antifouling is covered with antifouling panels caused to firmly adhere thereto and fixed. Not only can this work be conducted easily and quickly but also part of the antifouling panels can be easily replaced. The disclosed antifouling wall structure and the method of constructing the antifouling wall are characterized in that antifouling panels each comprising a base material layer and, formed thereon, an antifouling paint layer are arranged on a wall surface of structure to be rendered antifouling so that the antifouling panels have their side of antifouling paint layer brought into contact with water and detachably fixed by means of fastening members.

U.S. Pat. No. 5,344,531, which issued to Saito et al on Sep. 6, 1994, describes a prevention method of aquatic attaching fouling organisms and its apparatus. The invention relates to a method of preventing or controlling aquatic attaching fouling organisms which comprises covering aquatic organisms attaching portions on the surfaces of submerged structures or intake facilities with a plurality of mutually insulated metallic covers made of iron, magnesium, aluminum or their alloys through an insulating material and a cushion; using each of the metallic covers as an electrode; forming an electric circuit using the metallic covers facing each as a pair, connecting the electrode to a D.C. power supply having a polarity reversal function so as to supply a current between both poles either continuously or intermittently, and reversing the polarity of the current so that when one of the metallic covers is an anode, the surface of the metal constituting the metallic cover is dissolved and activated, and attachment of the aquatic fouling organisms to the surfaces of the metallic covers is prevented or controlled.

World Intellectual Property Organization patent application WO 98/18855, which was filed by Gedeon et al on Oct. 23, 1999 and assigned the International Application number PCT/US97/18964, describes a silicon coating composition. Corrosion resistant coatings are provided by Aqueous-alcoholic acidic dispersions of the partial condensate of monomethyl silanol (by hydrolysis of monomethyl alkoxysilane) alone or in mixture with minor amounts of other silanol (e.g., gamma-glycidyloxy silanol, phenyl silanol, etc.) wherein the dispersions contain divalent metal cations (e.g., $Ca^{+2}$) in place of all or most of colloidal silica used in prior formulations of this type. The coatings may be applied to boat hull, including aluminum hulls and are effective in preventing corrosion from salt water for extended periods.

U.S. Pat. No. 4,196,064, which issued to Harms et al on Apr. 1, 1980, describes a marine fouling control apparatus. A structure exposed to a marine environment is coated with a coating comprising stainless steel particles such as stainless steel flakes in a coating matrix. Marine growth is removed from the coating by impressing an electrical potential. Marine growth is also prevented. Preferably, the structure is coated with a first coating comprising metallic zinc prior to coating with a second coating comprising stainless steel flakes in an inorganic polymer matrix, and a cathodic potential is impressed.

U.S. Pat. No. 4,297,394, which issued to Wooden et al on Oct. 27, 1981, describes a piezoelectric polymer antifouling coating and method of use and application. An antifouling coating with method of use and method of application on marine structures in the form of a film containing piezoelectric polymer material, which, when electrically activated vibrates at a selected frequency to present a surface interfacing with water which is inhospitable for attachment of vegetable and animal life including free-swimming organisms thereby discouraging their attachment and their subsequent growth thereon to the macrofoulant adult stage.

Certain types of ambient temperature cured glass (ATC glass) is available in commercial quantities from the Adsil Corporation. According to Adsil, the ambient temperature cured glass offers the combined benefits of low toxicity and high protection from most causes of corrosion. It is made from glass and is impervious to nearly all corrosive materials. Covalent bonding allows these glass coatings to permanently adhere with nearly any surface. The silica is absorbed into small gaps in the surface of the material and, according to Adsil, even between molecules. As a result of the unique properties of covalent bonding, these glass coatings permanently adhere to most metals such as copper, aluminum, stainless and galvanized steel, and other metals. It is usable on painted metals, fiberglass, roofing materials, cement, bricks, and tile. The inorganic glass coatings are chemically engineered to form a permanent bond with whatever surface on which it is applied. Described by the term "covalent bonding", these coatings work their way into minute gaps in the surface. Covalent bonding allows the coating to grip the surface. The coating does not degrade.

The patents described above are hereby explicitly incorporated by reference in the following description.

As described above, fouling of underwater surfaces has been recognized as a problem for many years. Anti-fouling techniques, such as biocidal paints, can contribute to the pollution of waterways. Many other methods simply are not effective. It would therefore be significantly beneficial if a device or method could be developed which does not pollute the environment, but which effectively inhibits the growth of marine organisms on surfaces which are submerged in water such as boat hulls, pipes, pilings, and grates.

The Staerzl patents describe above (i.e. U.S. Pat. Nos. 6,173,669 and 6,209,472) are generally related to systems and apparatus which cause an electric current to flow between submerged conductive materials and other electrodes in such a way that gaseous chlorine is formed on the surface of the material when the electrically conductive material is connected as an anode to a source of power, such as a current source. It has been determined that the production of chlorine gas in this way is effective in inhibiting the growth of organic material, such as barnacles, on the surface.

The conductive material used to create the gaseous chlorine on its surface can be virtually any conductive material. However, the properties of certain conductive materials significantly affect the applicability of those materials for these purposes. For example, the use of an active metal as an anode can result in a degradation of the metallic electrode because metallic ions are typically emitted from the conductive materials into the surrounding seawater. This is a natural result caused by the use of the active metal as an anode in the circuit. Other materials, such as graphite, do not exhibit this tendency to give off ions into the seawater and, therefore, are not eroded in this way. However, materials such as graphite also exhibit a higher resistance to electric current flow because of the manner in which the coating is typically formulated. Other materials, such as silver, gold, and platinum, could serve as effective electrodes for the purpose of producing gaseous chlorine, but these materials are expensive and therefore could not be used in large quantities without being cost prohibitive.

It would therefore be significantly beneficial if an electrically conductive coating, such as a paint, could be used for these purposes in which an active metal such as nickel acts as the electrode. The use of an electrically conductive paint would also allow the system to be used in conjunction with non metallic materials, such as fiberglass hulls of marine vessels. It would also be significantly beneficial if a means could be provided for inhibiting the movement of ions from the electrically conductive material into the surrounding seawater which could otherwise result in the rapid corrosion and degradation of the electrically conductive material.

SUMMARY OF THE INVENTION

An apparatus for inhibiting the fouling of an underwater object made in accordance with the present invention, comprises an electrically conductive surface of the underwater object. This electrically conductive surface can be the surface of an electrically conductive material or, alternatively, the electrically conductive surface can be a conductive coating disposed on the surface on the underwater object. The present invention further comprises an electric current source which is connectable in electrical communication with the electrically conductive surface. The electric current source can be a power supply, associated with a battery, that provides a DC current to the electrically conductive surface.

The present invention further comprises a protective coating disposed on the electrically conductive surface. In a particularly preferred embodiment of the present invention, the protective coating is a glass coating which inhibits the flow of ions from the electrically conductive surface into the surrounding water, but readily permits the flow of electrons through the protective coating. The present invention further comprises an electrode which is connectable in electrically communication with the electric current source in order to form an electrical circuit comprising the electrically conductive surface, the electric current source, the electrode, and the water in which both the electrode and the electrically conductive surface are disposed.

The protective coating can be a glass coating and, in a particularly preferred embodiment of the present invention, can be an ambient temperature cure glass such as that is available in commercial quantities from the Adsil Corporation. That type of ambient temperature cure glass (ATC Glass) is described above.

If the underwater object is made of metal, the electrically conductive surface can comprise the same material as the underwater object and, is actually the surface of the underwater object itself. However, the electrically conductive service can also be a conductive coating disposed on the underwater object when the underwater object is non metallic in nature. For example, the electrically conductive surface can be a nickel coating or a graphite coating. The electric current flowing through the electrical circuit described above can be unidirectional or, alternatively, can be periodically reversed with the electrically conductive surface alternatively acting as an anode and a cathode of the electrical circuit.

The protective coating, used in a preferred embodiment of the present invention, discourages ionic transfer between the electrically conductive surface and the water, which is typically seawater, but the protective coating permits electron transfer between the electrically conductive surface and the water. The underwater object can be a boat hull. The electrode of the present invention can comprise a second electrically conductive surface identical to the electrically conductive surface described above. In addition, the second electrically conductive surface can be a surface of a second underwater object. For example, two portions of a boat hull can be electrically isolated from each other and connected only through the electrical circuit described above. In this way, the two surfaces provide first and second electrically conductive surfaces that alternatively are connected as the anode and the cathode in the electrical circuit. Under the various embodiments of the present invention, gaseous chlorine is formed on the protective coating which is, in turn, deposited on the conductive surface.

The method of the present invention for inhibiting the fouling of an underwater object comprises the steps of providing an electrically conductive surface of the underwater object, causing an electric current to flow through the electrically conductive surface, disposing a protective coating on the electrically conductive surface, and connecting an electrode in electrical communication with the electrically conductive surface to form an electrical circuit comprising the electrode, the electrically conductive surface, and the water in which both the electrode and the electrically conductive surface are disposed. The electrode can be a second electrically conductive surface similar to the first, wherein the first and second electrically conducted surfaces are alternatively applied as anode and cathode in the electrical circuit.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
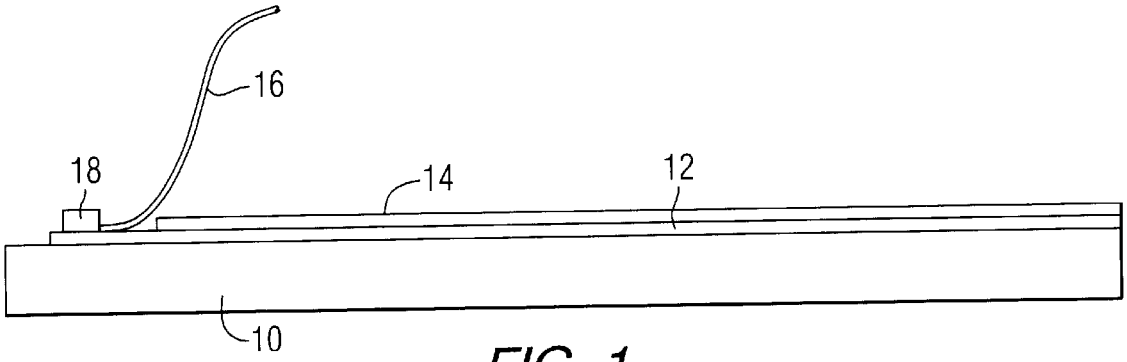
FIG. 1 is a schematic representation of an object on which an electrically conductive coating is applied along with a protective coating.

Throughout the description of the preferred embodiment of the present invention, like components will be identified by like reference numerals.

FIG. 1 is a highly simplified illustration of an underwater object 10 with an electrically conductive surface 12 disposed on it. In the example shown in FIG. 1, the electrically conductive surface 12 is disposed on a nonconductive underwater object 10, such as a fiberglass boat hull. A protective coating 14 is disposed on the electrically conductive surface 12. The protective coating 14 can be a glass coating and, in a particularly preferred embodiment of the present invention, can be an ambient temperature cure glass (ATC glass) such as that which is described in U.S. Pat. No. 5,929,159 and is available from the Adsil Corporation in commercial quantities. Although the electrically conductive surface 12 is illustrated as a coating on the underwater object 10 in FIG. 1, it should be understood that the electrically conducted surface can also be the surface of an electrically conductive underwater object.

The electrically conducted surface 12 can be a nickel-bearing paint, a graphite paint, or any other type of coating or paint in which suspended conductive particles are contained. These electrically conductive paints are commercially available from various sources. The conductor 16, such as an electrical wire, is connected in electrical communication with the electrically conductive surface 12 by a suitable fastener 18, such as a screw or bolt.

The purpose of the protective coating 14 is to inhibit ion transfer between the electrically conductive coating 12 and the surrounding seawater. If metallic ions are allowed to migrate from the electrically conductive coating 12 into the seawater, the electrically conductive coating 12 will eventually disintegrate and become useless. The protective coating 14 is intended to inhibit this ion transfer while permitting electron movement through the thickness of the protective coating 14.

Figure 2:
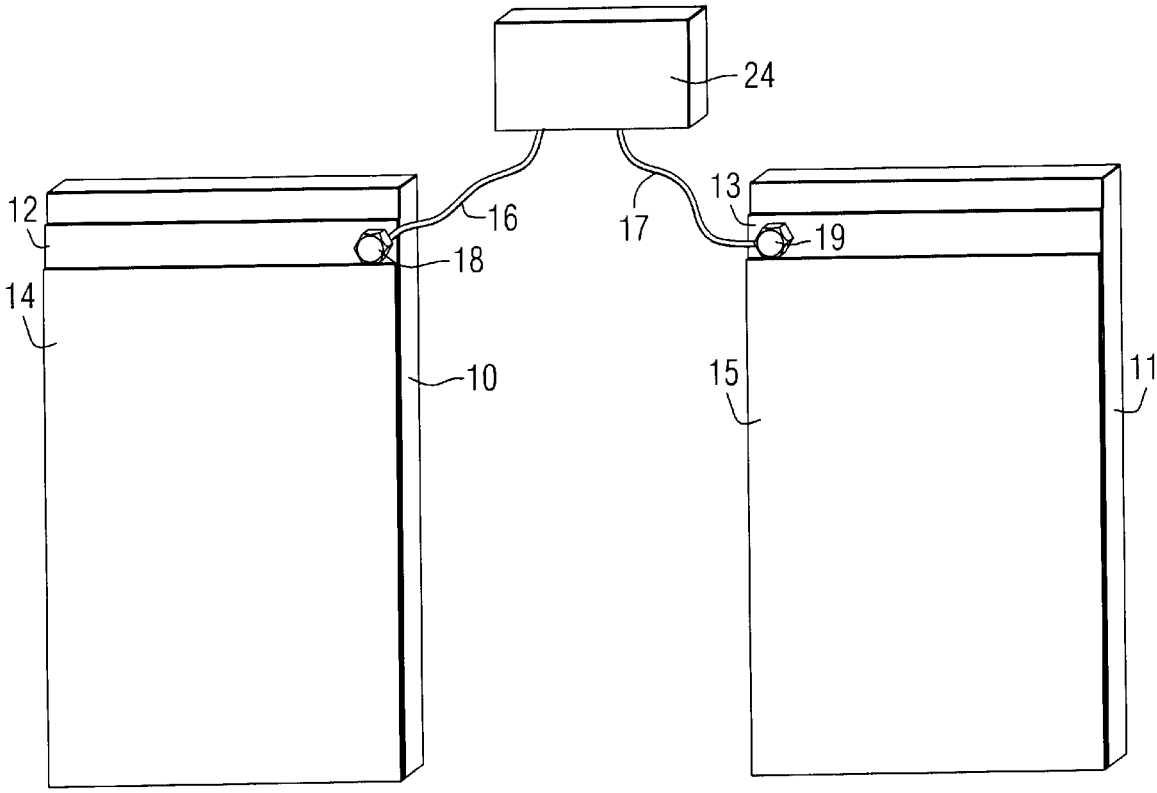
FIG. 2 shows an application of the present invention in which two electrically conductive coatings are protected by two associated protective coatings.

FIG. 2 shows two underwater objects, 10 and 11. These underwater objects, 10 and 11, are associated with an electrically conductive surfaces, 12 and 13, respectively. These two electrically conductive surfaces, 12 and 13, are associated with protective coatings, 14 and 15, respectively. Electrical conductors, 16 and 17, are connected to associated electrically conductive surfaces, 12 and 13, by appropriate fasteners, 18 and 19, respectively. An electric current source 24 is connected in electrical communication with the electrically conductive surfaces.

With continued reference to FIG. 2, it should be understood that two identical electrically conductive surfaces, such as 12 and 13, are not necessary in all embodiments of the present invention. One of the electrically conductive surfaces can be replaced by a simple electrode that serves to provide a completed electric circuit. However, where two underwater objects, 10 and 11, require protection from marine fouling, the two underwater objects can be connected as shown in FIG. 2 so that each serves as the electrode for the other for the purpose of completing the electrical circuit. The electrical circuit in FIG. 2 comprises the electrically conductive surfaces, 12 and 13, the electric current source 24, and the surrounding seawater in which both underwater objects, 10 and 11, are disposed. The seawater is not illustrated in FIG. 2.

When two electrically conductive surfaces, 12 and 13, are connected as shown in FIG. 2, the electrical current provided by the electric current source 24 can be periodically reversed so that each of the two electrically conductive surfaces alternatively acts as the anode in the circuit. The protective coatings, 14 and 15, inhibit metal ions from migrating away from the electrically conductive surfaces, 12 and 13, into the seawater, but they permit electrons to flow into the seawater from those two electrically conductive surfaces.

Figure 3:
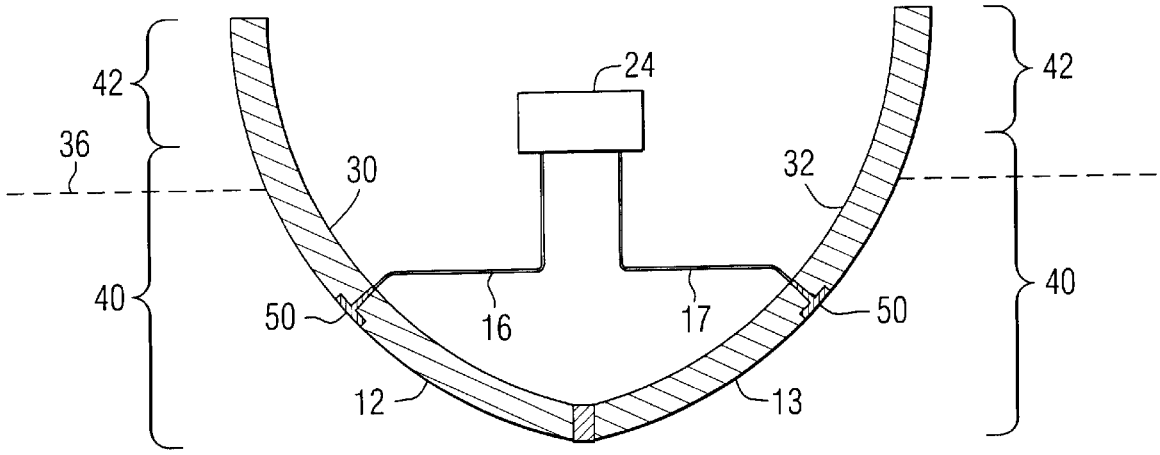
FIGS. 3 and 4 show a boat hull incorporating the present invention.

FIG. 3 is a simplified schematic representation of a marine vessel hull which comprises a port side 30 and a starboard side 32. The hull is partially submerged in a body of water, wherein the surface of the water is represented by dashed line 36. The brackets illustrate both typically wetted 40 and typically unwetted 42 portions of the hull. The frequently wetted portions 40 are susceptible to marine fouling through the growth of various marine organisms, such as barnacles. The outer surfaces, 12 and 13, of the port and starboard portions of the hull are provided with a coating of an electrically conductive material, such as nickel-bearing paint, and a protective coating disposed over the electrically conductive surface. These two coatings are not illustrated in FIG. 3, but are shown in the enlarged section view of FIG. 4.

Figure 4:
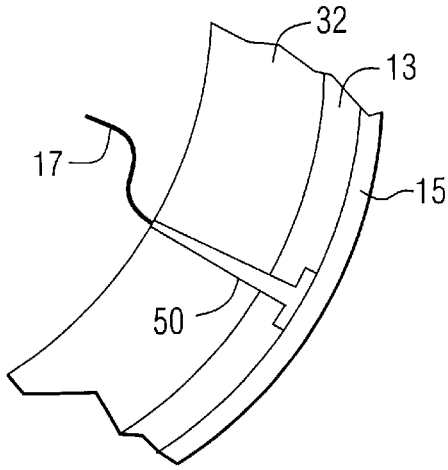

In FIGS. 3 and 4, the electrically conductive surface 13 is applied to the outer surface of the respective hull portion, such as the starboard side 32, and the protective coating 15 is disposed over the outer surface of the electrically conductive surface. An electrical conductor 50 is attached in electrical communication with the electrically conductive surface 13 and, by conductors 17, to the electric current source 24.

The arrangement shown in FIG. 3 is disclosed in greater detail in U.S. Pat. Nos. 6,173,669 and 6,209,472, which are described above. The protective coating 15 is a type of glass coating which can be of a formulation such as that described in U.S. Pat. No. 5,592,159, which is described above.

Figure 5:
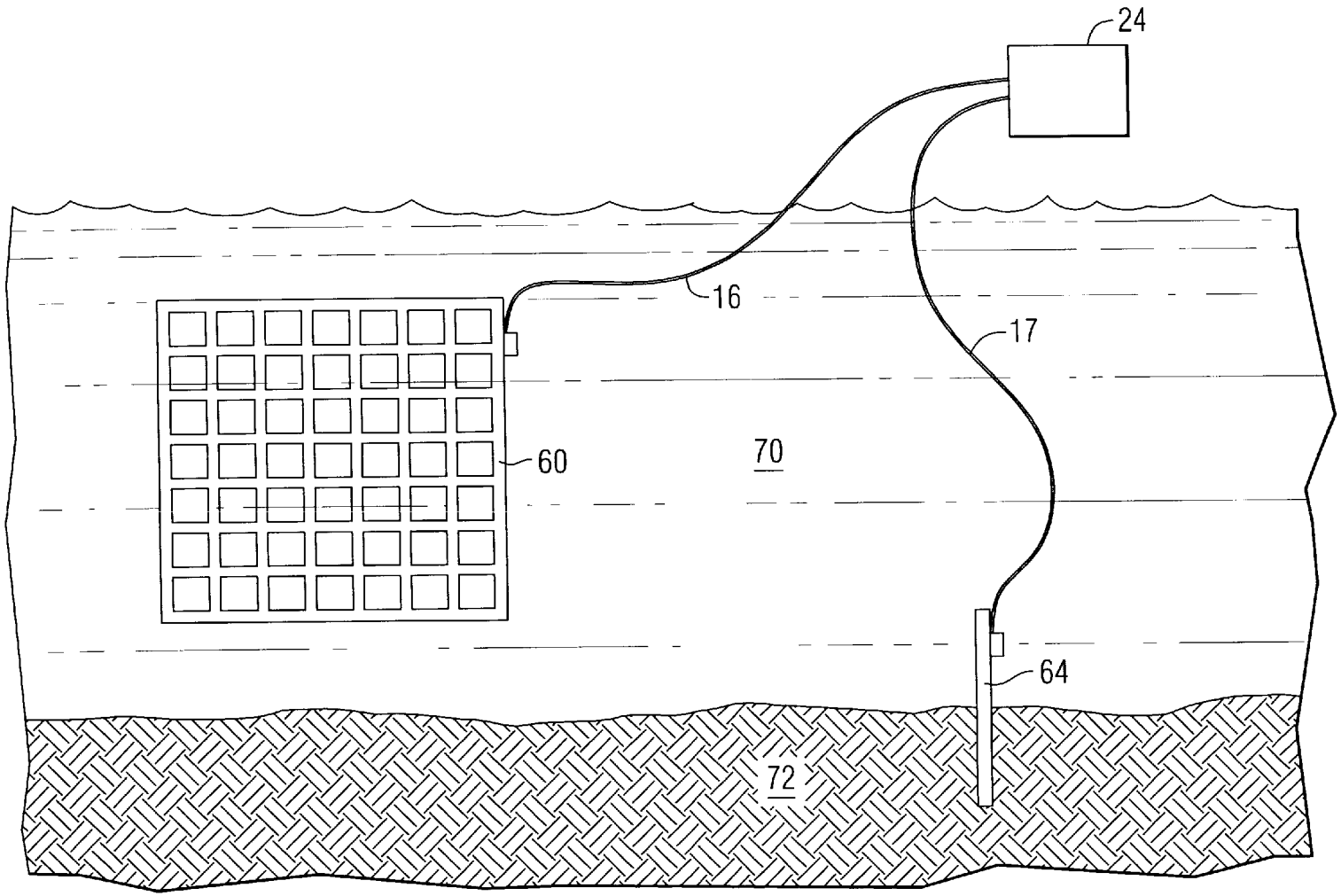
FIG. 5 shows a submerged grate protected by the present invention.

FIG. 5 shows another type of application in which the present invention can be used to inhibit fouling of an underwater object. A metallic grate 60 is coated with a protective coating, similar to that identified by reference numerals 14 and 15 above in conjunction with FIG. 2. No additional electrically conductive surface, in addition to the outer surface of the base material of the grate 60, is needed in this type of application. An electrical conductor 16 is connected between the electrically conductive surface of the grate 60 and an electric current source 24 which can be a power supply associated with an electrical battery. An electrode 64 is provided to complete the circuit which comprises the electrically conductive surface of the grate 60, the electric current source 24, the electrode 64, the two electrical conductors, 16 and 17, and the seawater 70 in which both the grate 60 and the electrode 64 are disposed. Reference numeral 72 is used to identify a sea bed under the seawater 70. In a situation similar to that shown in FIG. 5, the grate 60 would be connected as the anode of the circuit, with electrons being provided from the electric current source 24 to the electrode 64 and from the grate 60 through conductor 16 to the electric current source 24. This direction of electron flow will create chlorine gas bubbles on the surface of the grate 60 in the way which is described below in conjunction with FIG. 9. The protective coating (not shown in FIG. 5) on the electrically conductive surface of the grate 60 inhibits the migration of metal ions from the grate 60 into the seawater 70. This reduces the likelihood that the grate 60 will be corroded by galvanic action. The protective coating, as described above, allows electrons to flow from the base material of the grate 60 through the protective coating and into the seawater 70.

Figure 6:
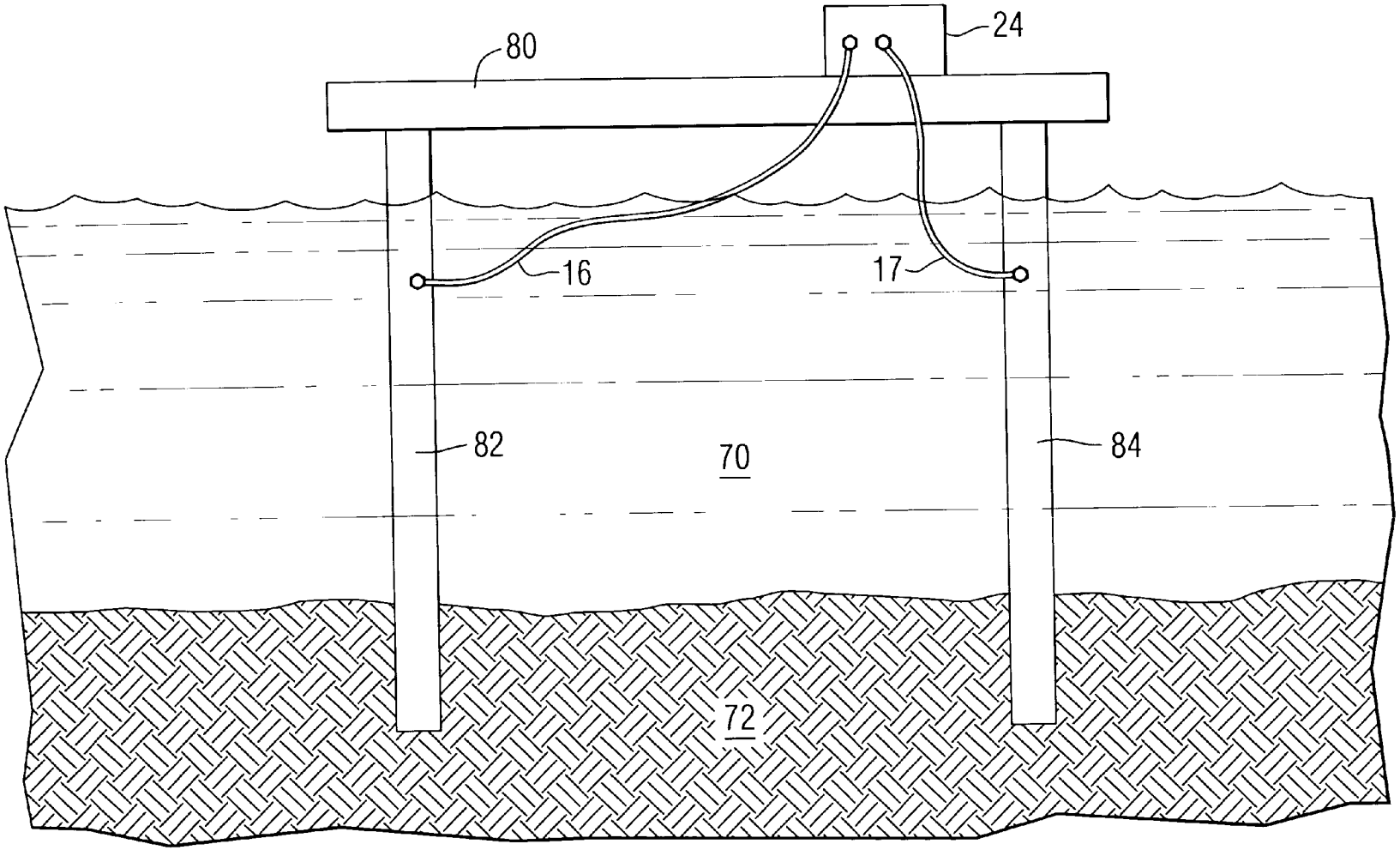
FIG. 6 shows metal columns of a pier or dock protected by the present invention.

FIG. 6 shows a dock 80 supported by two metal columns, 82 and 84. Large portions of the columns, 82 and 84, are submerged in seawater 70. This subjects the columns, 82 and 84, to significant marine fouling resulting from the growth of marine organisms, such as barnacles and other marine organisms. An electric current source 24 is shown connected to both columns, 82 and 84, so that an electrical circuit can be created which comprises the electric current source 24, the two columns, 82 and 84, the electrical conducts, 16 an 17, and the seawater 70. If no protective means is provided for the columns, 82 and 84, the column acting as the anode of the circuit can be quickly corroded through galvanic action. However, if the submerged portions of the columns are coated with a protective coating, such as the ambient temperature cure glass (ATC glass) described above, metal ions will not migrate from the columns, 82 and 84, into the seawater 70. If the direction of current flowing through the electrical circuit is periodically reversed, each of the columns will act as an anode for some preselected period of time. When acting as an anode, that column will generate gaseous chlorine at its surface. Electrons are permitted to flow through the protective coating on the two columns, but ions are inhibited from migrating from the metal columns.

Figure 7:
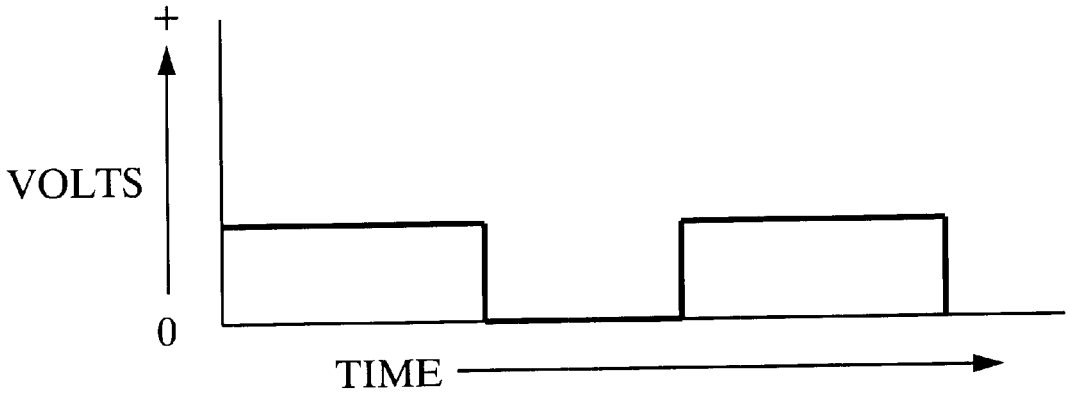
FIGS. 7 and 8 show two patterns of application of voltage by an electric current source to a protected object.

FIG. 7 is a graphical representation of one application of current, from the electric current source 24, to the electrically conductive surface. The current represented in FIG. 7 is direct current (DC) which is periodically turned off and on again. It has been determined that if a DC current is caused to flow from the electrically conductive surface for approximately 20 to 40 minutes, sufficient gaseous chlorine is formed on the surface to be protected to discourage the growth of marine organisms.

It has been empirically determined that generating a current into the electrically conductive surface for a period of approximately 20 to 40 minutes is sufficient to create gaseous chlorine in quantities that inhibits marine growth. Once the gaseous chlorine is formed on the surface, the chlorine bubbles tend to cling to the surface for a period of time. This allows the electric current source to be deactivated for a period of time, as represented in FIG. 7 and then reactivated. It should be understood that the chlorine bubbles tend to be reabsorbed into the seawater over time. In addition, wave action tends to separate the gaseous chlorine bubbles from the surface being protected. This necessitates subsequent reactivation of the electric current source to generate new gaseous chlorine at the surface. The illustration of FIG. 7 is most typical of applications of the present invention in which an electrode, such as that identified by reference numeral 64 in FIG. 5, is used with a component to be protected, such as the grate 60. In other words, the grate 60 is maintained as the anode at all times when the electric current source 24 is active. The electrode 64 can be an object that does not require protection and, therefore, is never connected as the anode.

Figure 8:
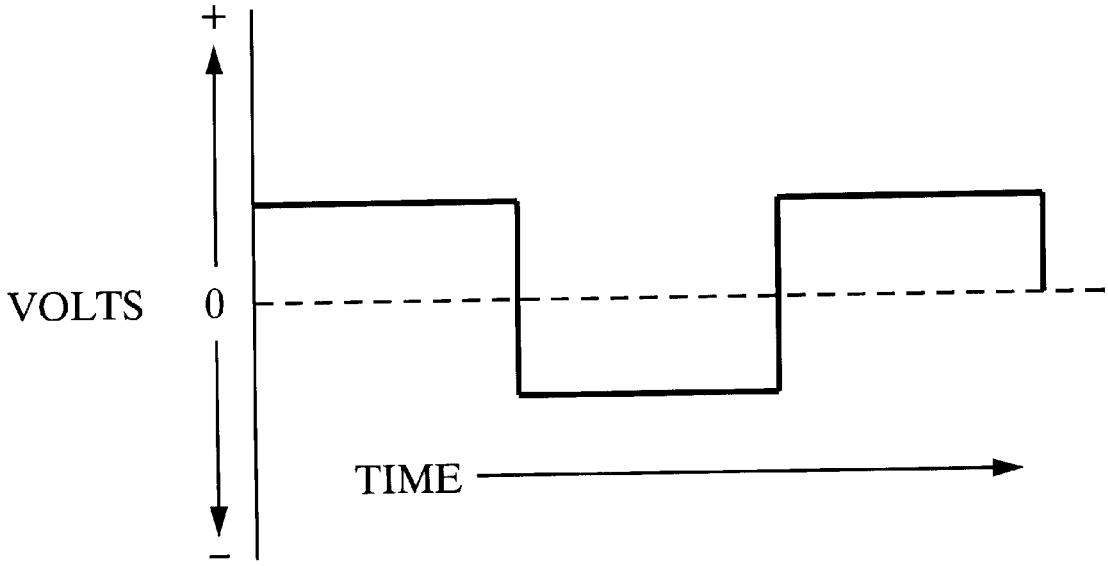

FIG. 8 shows an alternative method for operating the electric current source in conjunction with the present invention. The voltage is periodically reversed at timed intervals generally equivalent to 20 to 40 minutes. When switched, the anode becomes the cathode and the cathode becomes the anode. While the anode is generating chlorine gas to inhibit marine growth, the electrically conductive surface acting as the cathode experiences a decrease in the quantity of chlorine gas clinging to its surface. Empirical tests have indicated that various time intervals in conjunction with various current levels can be selected to maintain sufficient chlorine on both surfaces, periodically, over long periods of time to inhibit marine growth. Although specific electrical current magnitudes and densities are not described herein, the specifications of U.S. Pat. Nos. 6,173,669 and 6,209,472, described above, disclose various quantitative measurements used in empirical studies.

The improvement provided by the present invention is that the protective coating allows less expensive and less resistive materials to be used as the electrically conductive surface. In other words, nickel-bearing paint can be used as an electrically conductive surface which is applied as a paint coating on the underwater object to be protected. Normally, the nickel which is suspended in the paint could degrade as a result of the ion transfer from the metal to the seawater. Through the use of the protective coating, such as the glass coatings described in U.S. Pat. No. 5,929,159, nickel-based paint can be used. The nickel paint is preferable to a graphite paint because nickel exhibits a lower electrical resistance than graphite. Although graphite-bearing paint is less susceptible to degradation resulting from ion transfer to the seawater, its higher electrical resistance can require higher power consumption in some applications. Certain metals, such as gold, silver, and platinum, can be used as a highly efficient electrically conductive surface which is not susceptible to rapid degradation through ion transfer to the seawater. However, these materials are significantly more expensive than nickel-bearing paint. In combination, a nickel-bearing paint coated with a protective coating of a corrosion resistant coating such as that described in U.S. Pat. No. 5,929,159, provides an advantageous combination which reduces cost while inhibiting corrosion degradation that can result from the migration of metal ions from the electrically conductive coating to the seawater.

Figure 9:
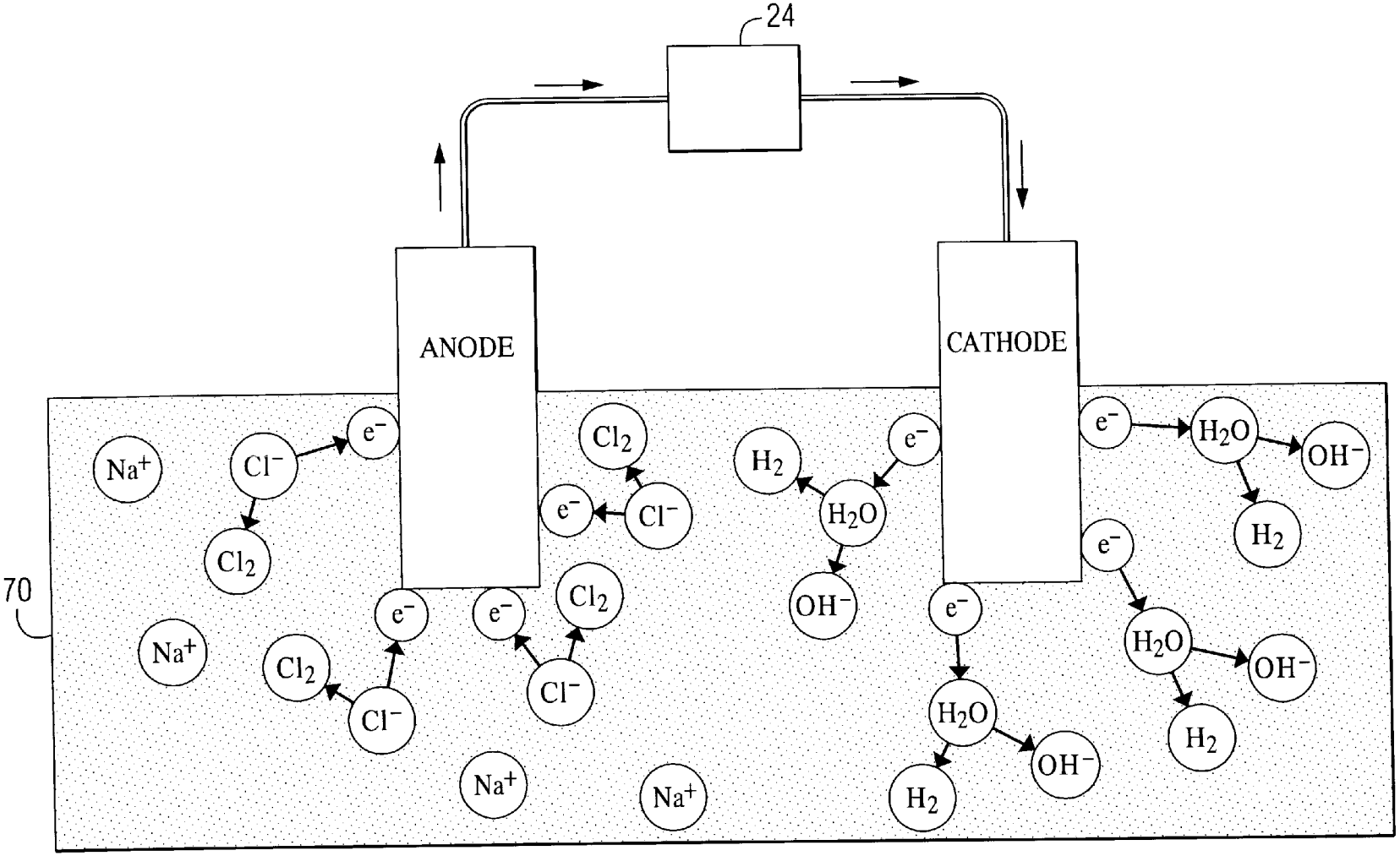
FIG. 9 illustrates the hypothetical electrical chemical reactions induced by the present invention.

FIG. 9 illustrates some of the hypothetical electrical chemical reactions that occur as a result of the operation of the present invention. It should be understood that the reactions illustrated in FIG. 9 are highly simplified and deal only with the relationship between the sodium chloride in seawater and the electrodes of the present invention. Many other different types of salts are typically present in seawater and the actual electrical chemical reactions, in reality, would be more complex then shown in FIG. 9, When the electrically conductive surface of the present invention is connected as the anode to the electrical current source 24, it receives electrons as a result of the oxidation of the chloride ion $Cl^-$. This results in chlorine ($Cl_2$) in a gaseous form at the surface of the anode. At the cathode, molecules of water receive electrons from the cathode and this produces hydroxyl ions ($OH^-$) plus hydrogen gas. The reaction of the cathode occurs as the water is hydrolyzed and the reaction at the anode occurs by the oxidation of the chloride ions. It is believed that these gases, chlorine and hydrogen, react with the water to yield hypochlorous acid and a hypochloride ion in proportions which depend on the acidity of the water proximate the anode and cathode elements.

With continued reference to FIG. 9, it is difficult to determine whether the marine organisms are inhibited primarily because of the presence of chlorine gas at the anode or the resulting creation of hypochlorous acid in combination with the hypochloride ions. Regardless of the specific effect that discourages marine growth, the creation of chlorine gas at the ion at the ion through the use of the present invention results in significantly less fouling of the protected surface.

With continued reference to FIG. 9, it should be understood that the use of a metal anode, without a protected coating, would eventually degrade and destroy the anode through galvanic action and corrosion. Instead of the electrical chemical reactions shown at the anode in FIG. 9, a metallic anode that is unprotected would give off metallic ions that would form metallic chlorides in the surrounding seawater. The migration of metallic ions from the anode, due to the lack of protection of the active metal, eventually destroys the anode. By providing the protective coating of glass, the present invention allows anodes to be made of active metals, such as in a nickel-bearing paint, which are much less expensive than certain metals (e.g. gold, silver, platinum) that could be used without a protective coating. The use of the protective coating also allows electrically conductive coatings to be used which exhibit much lower electrical resistances than alternatives such as graphite paint. As a result, the electrical chemical reactions illustrated in FIG. 9 can be achieved without the necessity of using expensive metals or higher resistance graphite as the anode. It should also be understood that the direction of the current, represented by the arrows in FIG. 9, can be periodically switched in many different embodiments of the present invention. As a result, the anode and cathode functions of the two partially submerged electrodes in FIG. 9 would be periodically reversed.

Although the present invention has been described with particular detail and illustrated with specificity to show several embodiments, it should be understood that alternative embodiments are also within its scope.

I claim:

1. Apparatus for inhibiting the fouling of an underwater object, comprising:

an electrically conductive surface of said underwater object;

an electric current source, which is connectable in electrical communication with said electrically conductive surface;

a protective coating disposed on said electrically conductive surface; and an electrode which is connectable in electrical communication with said electric current source to form an electrical circuit comprising said electrically conductive surface, said electric current source, said electrode, and water in which both said electrode and said electrically conductive surface are disposed.

2. The apparatus of claim 1, wherein:

said protective coating is a glass coating.

3. The apparatus of claim 1, wherein:

said protective coating is an ambient temperature cure glass.

4. The apparatus of claim 1, wherein:

said electrically conductive surface comprises the same material as said underwater object.

5. The apparatus of claim 1, wherein:

said electrically conductive surface is a coating disposed on said underwater object.

6. The apparatus of claim 5, wherein:

said electrically conductive surface is a nickel coating.

7. The apparatus of claim 5, wherein:

said electrically conductive surface is a graphite coating.

8. The apparatus of claim 1, wherein:

current flowing through said electrical circuit is unidirectional.

9. The apparatus of claim 1, wherein:

current flowing through said electrical circuit is periodically reversed, said electrically conductive surface alternately acting as an anode and a cathode of said electrical circuit.

10. The apparatus of claim 1, wherein:

said protective coating discourages ion transfer between said electrically conductive surface and said water, said protective coating permitting electron transfer between said electrically conductive surface and said water.

11. The apparatus of claim 1, wherein:

said underwater object is a boat hull.

12. The apparatus of claim 1, wherein:

said electrode comprises a second electrically conductive surface of a second underwater object.

13. The apparatus of claim 1, wherein:

gaseous chlorine is formed on said protective coating.

14. A method for inhibiting the fouling of an underwater object, comprising the steps of:

providing an electrically conductive surface of said underwater object;

causing an electric current to flow through said electrically conductive surface;

disposing a protective coating on said electrically conductive surface; and connecting an electrode in electrical communication with said electrically conductive surface to form an electrical circuit comprising said electrode, said electrically conductive surface, and water in which both said electrode and said electrically conductive surface are disposed.

15. The method of claim 14, wherein:

said protective coating is a glass coating.

16. The method of claim 15, wherein:

said protective coating is an ambient temperature cure glass.

17. The method of claim 14, wherein:

said electrically conductive surface is a coating disposed on said underwater object.

18. The method of claim 17, wherein:

said electrically conductive surface is a nickel coating.

19. The method of claim 17, wherein:

said electrically conductive surface is a graphite coating.

20. The method of claim 14, wherein:

current flowing through said electrical circuit is periodically reversed, said electrically conductive surface alternately acting as an anode and a cathode of said electrical circuit.

21. The method of claim 14, wherein:

said protective coating discourages ion transfer between said electrically conductive surface and said water, said protective coating permitting electron transfer between said electrically conductive surface and said water.

22. The method of claim 21, further comprising:

forming gaseous chlorine on said protective coating.

23. Apparatus for inhibiting the fouling of an underwater object, comprising:

means for providing an electrically conductive surface of said underwater object;

means for causing an electric current to flow through said electrically conductive surface;

means for disposing a protective coating on said electrically conductive surface; and means for connecting an electrode in electrical communication with said electrically conductive surface to form an electrical circuit comprising said electrode, said electrically conductive surface, and water in which both said electrode and said electrically conductive surface are disposed.

24. The method of claim 23, wherein:

said protective coating is a glass coating.

25. The method of claim 23, wherein:

said electrically conductive surface is a coating disposed on said underwater object.

26. The method of claim 25, wherein:

said electrically conductive surface is a nickel coating.

27. The method of claim 25, wherein:

said electrically conductive surface is a graphite coating.

28. The method of claim 23, wherein:

current flowing through said electrical circuit is periodically reversed, said electrically conductive surface alternately acting as an anode and a cathode of said electrical circuit.

29. The method of claim 23, wherein:

said protective coating discourages ion transfer between said electrically conductive surface and said water, said protective coating permitting electron transfer between said electrically conductive surface and said water.

30. The method of claim 23, further comprising:

gaseous chlorine is formed on said protective coating.

* * * * *